US008529145B2

(12) United States Patent
Cartón Cordero et al.

(10) Patent No.: US 8,529,145 B2
(45) Date of Patent: Sep. 10, 2013

(54) IMAGE FORMING APPARATUS, CUTTING DEVICE USABLE THEREWITH AND METHOD THEREOF

(75) Inventors: Carlos Miguel Cartón Cordero, Barcelona (ES); Ismael Chanclón Fernández, Barcelona (ES); Fernando Juan Jover, Viladecavalls (ES)

(73) Assignee: Hewlett-Packard Development Company, L. P., Houston, TX (US)

( * ) Notice: Subject to any disclaimer, the term of this patent is extended or adjusted under 35 U.S.C. 154(b) by 364 days.

(21) Appl. No.: 13/117,810

(22) Filed: May 27, 2011

(65) Prior Publication Data

US 2012/0297945 A1 Nov. 29, 2012

(51) Int. Cl.
*B41J 11/00* (2006.01)

(52) U.S. Cl.
USPC ..... 400/621; 400/642

(58) Field of Classification Search
USPC ..... 400/621
See application file for complete search history.

(56) References Cited

U.S. PATENT DOCUMENTS

| | | | | | |
|---|---|---|---|---|---|
| 4,979,838 | A | * | 12/1990 | Yokota et al. | 400/621 |
| 5,053,053 | A | * | 10/1991 | De Labbey et al. | 8/423 |
| 5,296,872 | A | * | 3/1994 | Caamano | 346/24 |
| 5,458,034 | A | * | 10/1995 | Cavagna | 83/488 |
| 5,791,218 | A | * | 8/1998 | Saito et al. | 83/92 |
| 5,881,623 | A | * | 3/1999 | Otani et al. | 83/455 |
| 6,260,457 | B1 | | 7/2001 | Hakkaku | |

* cited by examiner

*Primary Examiner* — Anthony Nguyen

(57) ABSTRACT

An image forming apparatus, a cutter device usable therewith and a method are disclosed. The image forming apparatus, cutter device and method include a cutter housing, a pair of rotary cutting wheels, a cutter guide, and a gear assembly. The pair of rotary cutting wheels pass through a cutting region to cut media transported along a media transport path.

20 Claims, 7 Drawing Sheets

IMAGE FORMING APPARATUS, CUTTING DEVICE USABLE THEREWITH AND METHOD THEREOF

BACKGROUND

Image forming apparatuses form images on media. Image forming apparatuses may be supplied with a variety of media including media in a form of a media supply roll. The roll media may be transported along a media transport path to a print zone to be printed thereon. Subsequently, the roll media may be cut by a cutter and output to a storage bin.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses form images on media which may be supplied thereto as roll media from media supply rolls and sheet media. The media may be transported along a media transport path to and from a print zone in which images may be formed on the media. Generally, the roll media is cut by a cutting device after images are formed on the roll media. The cutting device, however, may include a cutter guide that may obstruct media transported along a media transport path during a printing mode. Accordingly, the cutter guide may selectively move to correspond to the printing mode and a cutting mode. Also, the image forming apparatus may include media control members downstream from the cutting device to provide tension at a cutting region to assist the cutting device to cut the media. Selectively moving a cutter guide and adding media control members downstream from a cutting device may increase the number of components, cost and size of the image forming apparatus.

In examples, an image forming apparatus includes, among other things, a cutter device including a cutter housing, a pair of rotary cutting wheels, a cutter guide, and a gear assembly. The cutter housing may selectively engage the reciprocating printhead assembly to move across the media transport path in the cutting mode. The pair of rotary cutting wheels rotatably coupled to the cutter housing may pass through a cutting region traverse to the media transport path to cut the media in the cutting mode. The cutter guide is disposed outside of the cutting region and may remain in a same position in the printing mode and the cutting mode. Thus, the cutter guide is positioned not to obstruct the media along the media transport path in the printing mode. Accordingly, the cutter guide may remain stationary in the printing mode and the cutting mode. Further, the rotary cutting wheels may cut the media without media control members to provide tension at the cutting region disposed downstream from the cutting device. Thus, the rotary cutting wheels are able to adequately cut the respective media, for example, without media control members downstream of and output shaft and the cutting wheels. Consequently, increasing the number of components, costs and size of the image forming apparatus may be reduced.

Figure 1:
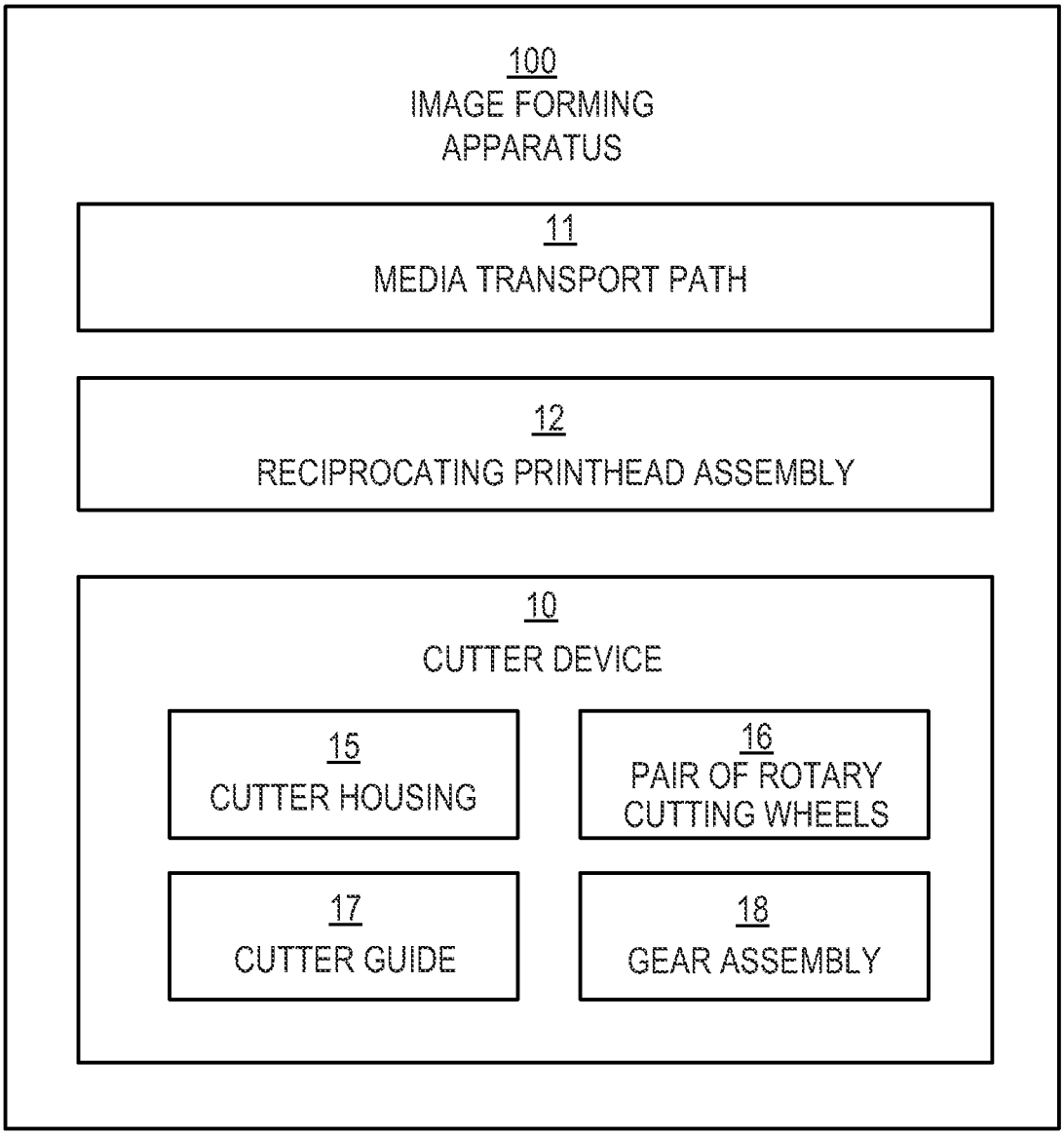
FIG. 1 is a block diagram illustrating an image forming apparatus according to an example.
Figure 2:
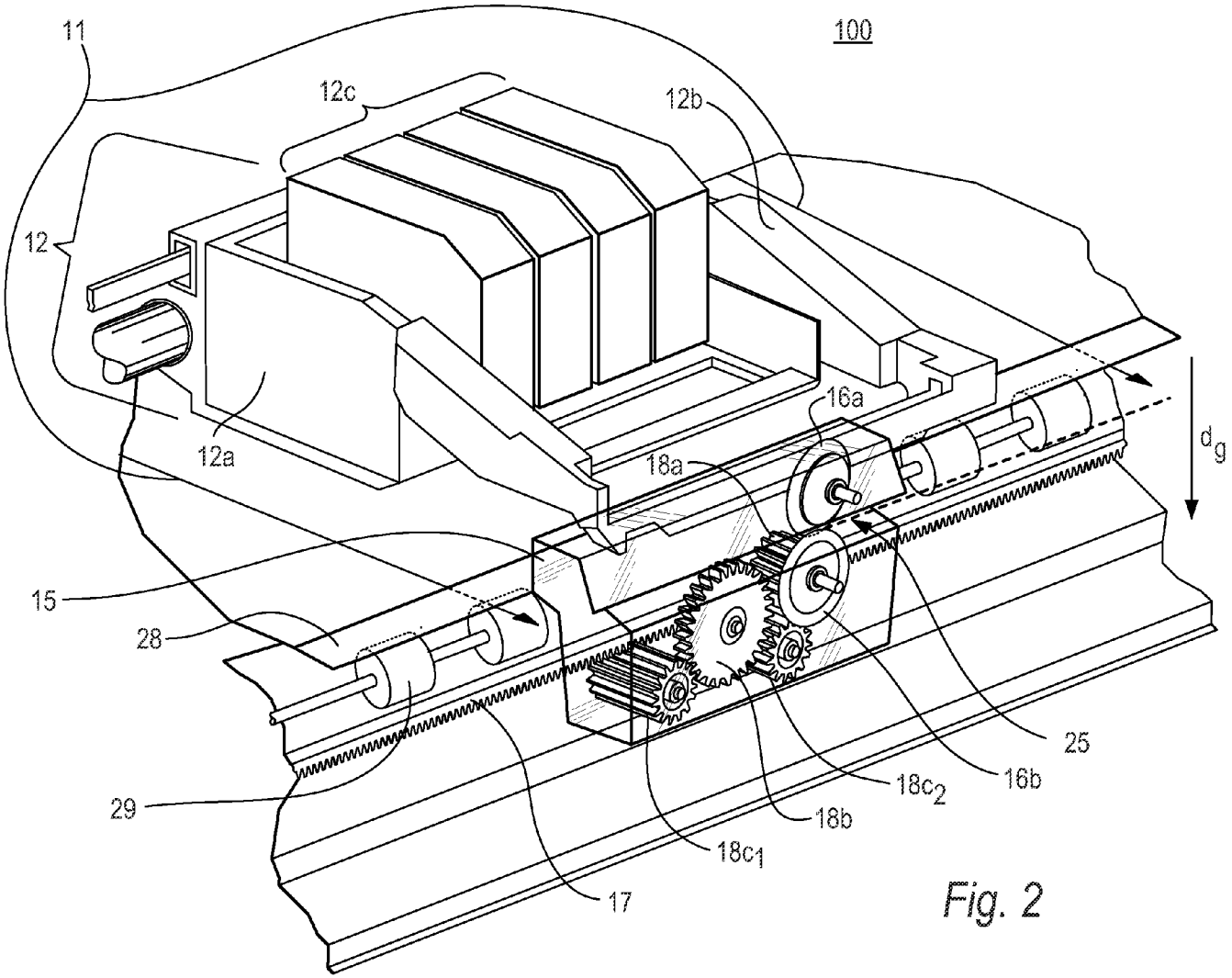
FIG. 2 is a perspective view illustrating a portion of an image forming apparatus according to an example.

FIG. 1 is a block diagram illustrating an image forming apparatus according to an example. FIG. 2 is a perspective view illustrating a portion of an image forming apparatus according to an example. Referring to FIGS. 1 and 2, in examples, an image forming apparatus 100 includes a media transport path 11, a reciprocating printhead assembly 12 and a cutter device 10. The media transport path 11 may transport media in a media advancement direction $d_a$. The reciprocating printhead assembly 12 may reciprocate across the media transport path 11 in a printing mode to print on the media and in a cutting mode. In examples, the reciprocating printhead assembly 12 may include a carriage device 12*a* having an engagement member 12*b* to engage the cutter housing 15 and removable printheads 12*c*. For example, each printhead may eject a particular color ink such as cyan, magenta, yellow and black.

Referring to FIG. 2, in examples, the cutter device 10 may include a cutter housing 15, a pair of rotary cutting wheels 16*a* and 16*b* (collectively 16), a cutter guide 17, and a gear assembly 18. The cutter housing 15 may selectively engage the reciprocating printhead assembly 12 to move across the media transport path 11 in the cutting mode. The pair of rotary cutting wheels 16 may be rotatably coupled to the cutter housing 15 to pass through a cutting region 25 traverse to the media transport path 11 to cut the media in the cutting mode. The cutter guide 17 may be disposed outside of the cutting region 25 and remain in a same position in the printing mode and the cutting mode. That is, the cutter guide 17 may be out of the way of the media to be transported along the media transport path 11 and fixed in one position. The gear assembly 18 may engage the cutter guide 17 and one of the rotary cutting wheels 16*b* to rotate the one rotary cutting wheel 16*b* in the cutting mode.

Referring to FIG. 2, the gear assembly 18 may engage the cutter guide 17 and the one rotary cutting wheel 16*b* to rotate the one rotary cutting wheel 16*b* in the cutting mode. Such engagement may be in response to a movement of the cutter housing 15 across the media transport path 11 (as well as along the cutter guide 17). That is, as the cutter housing 15, the pair of rotary cutting wheels 16, and the gear assembly 18 is pulled or pushed across the media transport path 11 by the reciprocating printhead assembly 12, the gear assembly 18 interacts with the cutter guide 17 to impart rotation to the one rotary cutting wheel 16*b*. Further, each one of the pair of rotary cutting wheels 16*a* and 16*b* is in contact with each other to allow a rotation of the one rotary cutting wheel 16*b* to rotate the other rotary cutting wheel 16*a*. In examples, a peripheral speed of the rotating rotary cutting wheels 16 is faster than a linear speed of the cutter housing 15 moving along the cutter guide 17.

As illustrated in FIG. 2, in examples, the gear assembly 18 includes a first circular gear member 18*a*, a pair of second circular gear members $\mathbf{18}c_1$ and $\mathbf{18}c_2$ (collectively 18*c*), and a third circular gear member 18*b*. The first circular gear member 18*a* may be coupled to the one rotary cutting wheel 16*b*. The first circular gear member 18*a* includes a first radius thereof. The pair of secondary circular gear members 18*c* may engage the cutter guide 17. Each one of the pair of second circular gear members 18*c* includes a second radius. The third circular gear member 18*c* may be coupled to the pair of secondary circular gear members 18*c* and the first circular gear member 18*a* to rotate the one rotary cutting wheel 16*b*. The third circular gear member 18*b* includes a third radius thereof that may be greater than the first radius and the second radius. The image forming apparatus 100 may also include an output shaft 29 to transport the media along the media transport path 11 and a guide member 28 to guide the media along the media transport path 11. In examples, the rotary cutting wheels 16*a* and 16*b* may cut the media without media control members to provide tension at the cutting region 25 disposed downstream, for example, from the rotary cutting wheels 16 and the output shaft 29. Thus, the rotary cutting wheels 16*a* and 16*b* are able to adequately cut the respective media, for example, without media control members downstream of and output shaft 29 and the rotary cutting wheels 16*a* and 16*b*.

Figure 3:
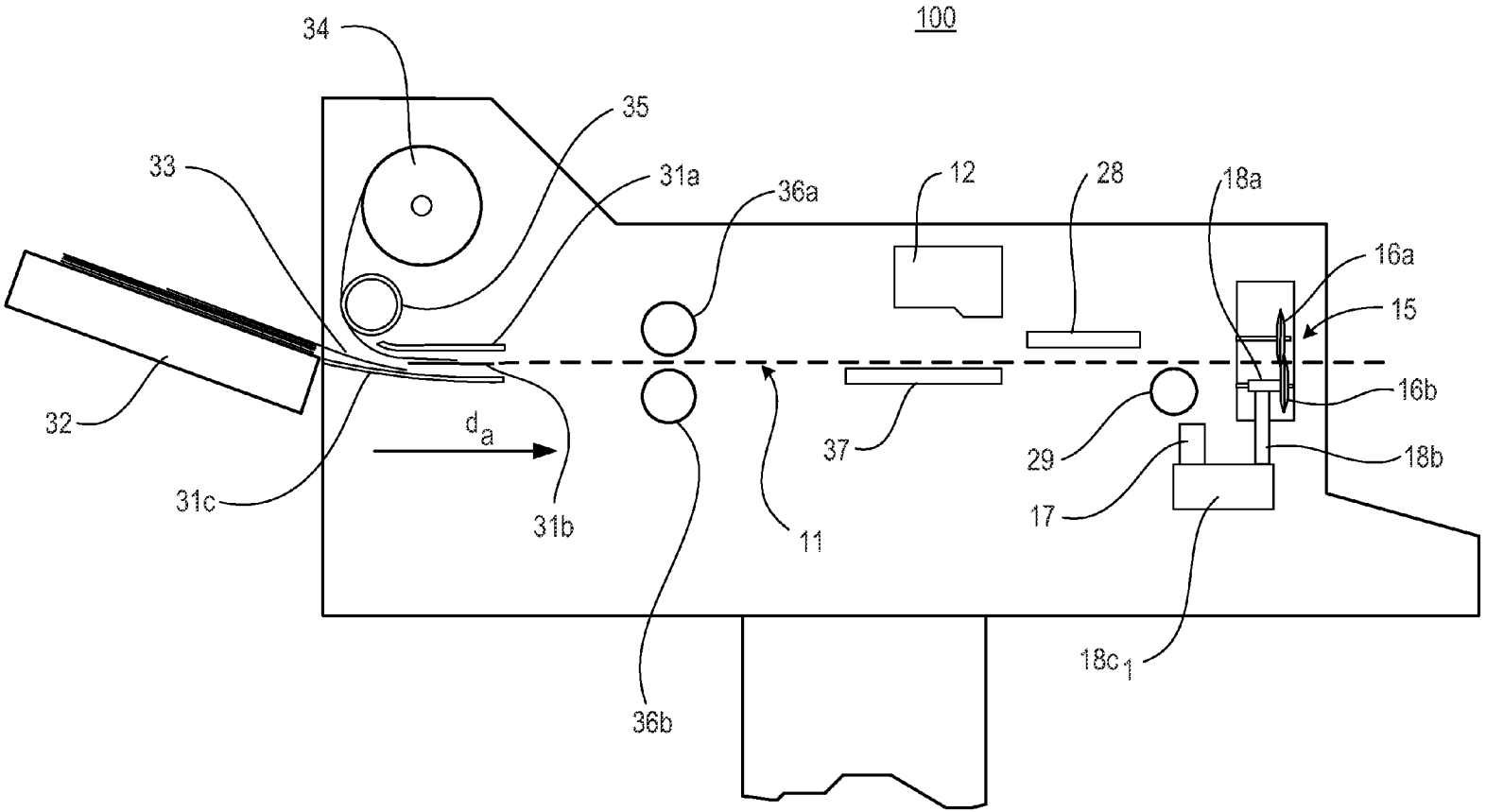
FIG. 3 is a cross-sectional view illustrating the image forming apparatus of FIG. 2 according to an example.

FIG. 3 is a cross-sectional view illustrating the image forming apparatus of FIG. 2 according to an example. Referring to FIG. 3, in examples, the media may be in a form of roll media 34. In the present example, the media may be in a form of roll media 34 and sheet media 33. The sheet media 33 may be supplied from a sheet tray 32. Each one of the roll media 34 and the sheet media 33 may be selectively and sequentially transported along the media transport path 11. As illustrated in FIG. 3, in examples, the image forming apparatus 100 may also include an input roller 35, a plurality of guiding plates 31, a pair of feed rollers 36*a* and 36*b* (collectively 36), a platen 37, a guide member 28, and an output shaft 29.

Referring to FIG. 3, in examples, the input roller 35 may contact and transport the roll media 34 into a roll media receiving area formed by respective guiding plates 31*a* and 31*b*. Sheet media 33 may be supplied from a sheet media tray 32 into a sheet media receiving area formed by respective guiding plates 31*b* and 31*c*. The guiding plates 31 may guide media received therein to the media transport path 11. The guiding plates 31 may include an upper plate 31*a*, a middle plate 31*b* and a lower plate 31*c*. In examples, the upper plate 31*a* and middle plate 31*b* may form a roll media 34 receiving area to receive the roll media and guide it to the media transport path 11. The middle plate 31*b* and the lower plate 31*c* may form a sheet media receiving area to receive sheet media 33 and guide it to the media transport path 11. The pair of feed rollers 36*a* and 36*b* (collectively 36) may contact and transport the respective media along the media transport path 11. The platen 37 may support the media in the media transport path 11 to be printed on by the printhead assembly 12 while in the printzone. In examples, the platen 37 may be in a form of a plate, ribs, or the like. Further, in examples, a vacuum pump (not illustrated) may create a suction force to selectively hold the respective media against the platen 37 while images are being formed thereon.

Referring to FIG. 3, in examples, the guide member 28 may guide the media along the media transport path 11. The output shaft 29 may transport the media along the media transport path 11, for example, to the cutting region 25. The output shaft 29 may be disposed upstream from the pair of rotary cutting wheels 16 of the cutting device 10 in the media advancement direction $d_a$. In examples, the cutter guide 17 may be disposed below the output shaft 29. Accordingly, the cutter guide 17 is out of the way of the media being transported along the media transport path 11. Thus, the cutting guide 17 may remain stationary with respect to the media transport path 11 in the printing mode and in the cutting mode. In the cutting mode, the pair of rotary cutting wheels 16 passes through the cutting region 25 to cut the media transported along the media transport path 11. In examples, in doing so, no media control members to provide tension to the media at the cutting region 25 are disposed downstream from the rotary cutting wheels 16 in the media advancement direction $d_a$.

Figure 4:
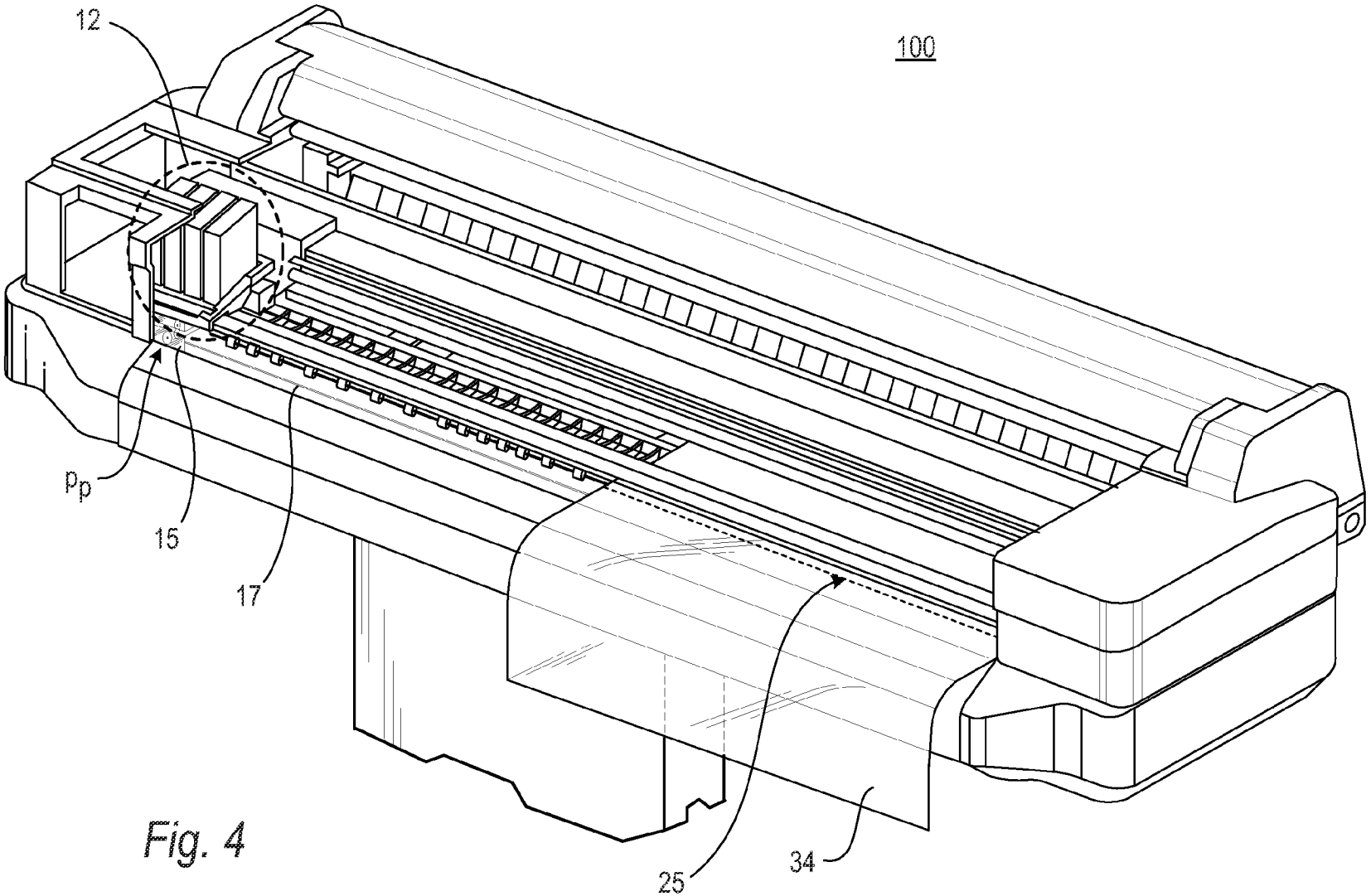
FIG. 4 is a perspective view illustrating the image forming apparatus of FIG. 1 according to an example.

FIG. 4 is a perspective view illustrating the image forming apparatus of FIG. 1 according to an example. As illustrated in FIG. 4, in examples, the cutter housing 15 is disposed in the park position p, for example, in the print mode. The park position p, for example, may be a position toward one end of the image forming apparatus 100 and outside of the media transport path 11. According, the cutter housing 15 may be placed in the park position p during the print mode to prevent the cutter housing 15 including the pair of rotary cutting blades 16 and gear assembly 18 attached thereto from unintentionally interfering with the respective media 34 in the media transport path 11. In the cutting mode, however, the reciprocating printhead assembly 12 may engage the cutter housing 15 in the park position p to move the cutter housing 15 across the media transport path 11 to cut the respective media 34 along the cutting region 25.

Figure 5:
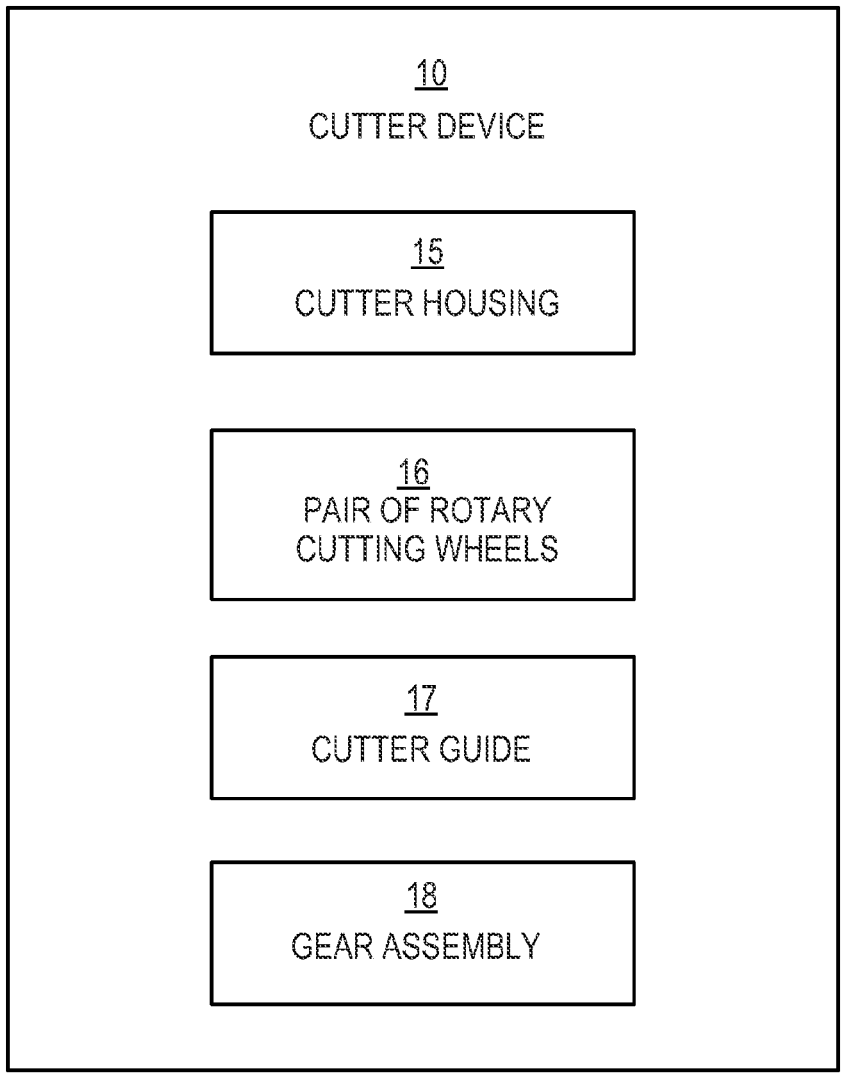
FIG. 5 is a block diagram illustrating a cutter device according to an example.
Figure 6:
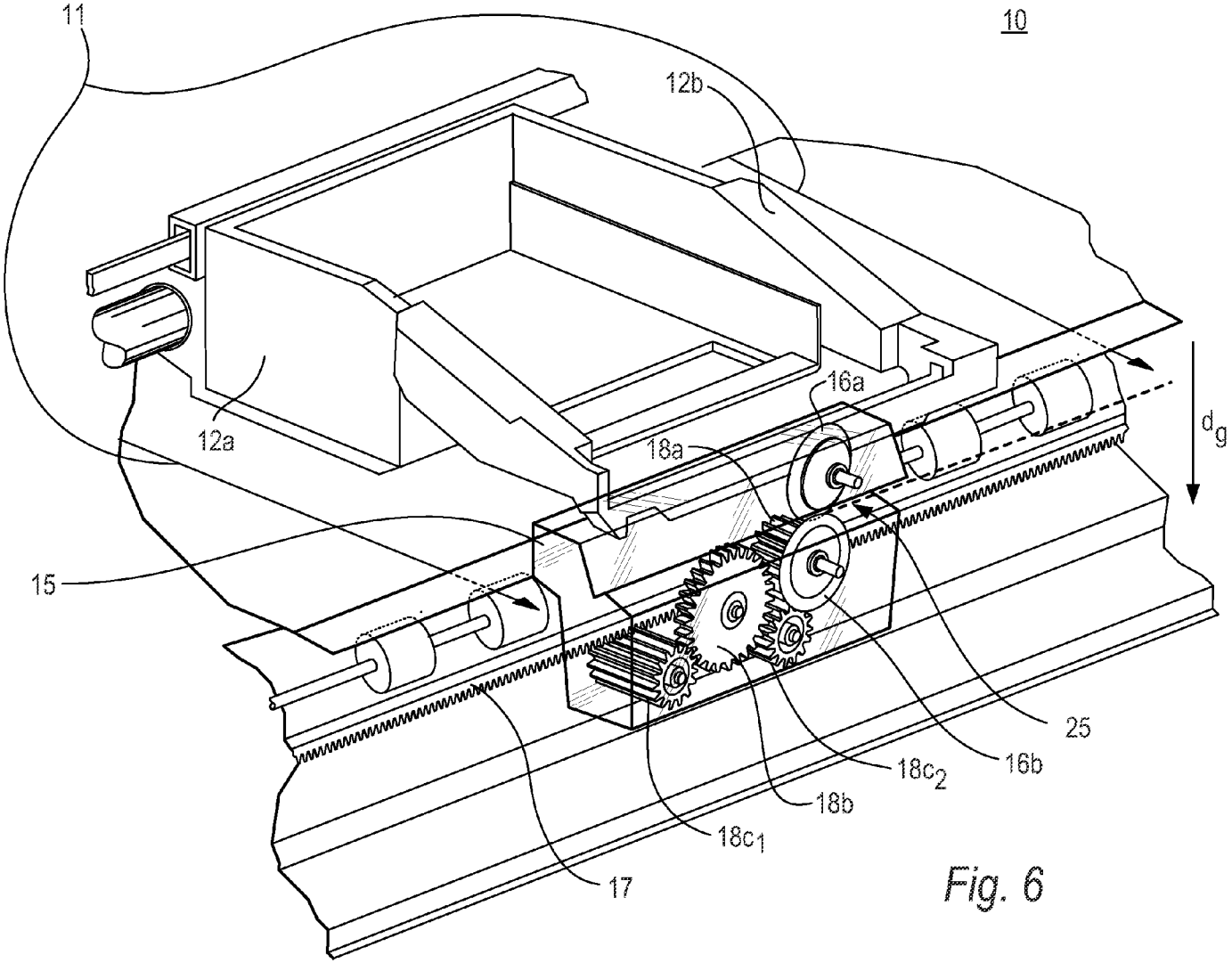
FIG. 6 is a perspective view illustrating the cutter device of FIG. 5 usable with an image forming apparatus according to an example.

FIG. 5 is a block diagram illustrating a cutter device according to an example. FIG. 6 is a perspective view illustrating the cutter device of FIG. 5 usable with an image forming apparatus according to an example. Referring to FIGS. 5 and 6, in examples, a cutter device 10 includes a cutter housing 15, a pair of rotary cutting wheels 16, a cutter guide 17, and a gear assembly 18. The cutter device 10 may be usable with an image forming apparatus 100 including a carriage device 12*a* and a media transport path 11. The carriage device 12*a* may include an engagement member 12*b*. The carriage device 12*a* may also receive removable printheads 12*c* therein to form a printhead assembly 12 (FIG. 2) and reciprocate across the media transport path 11.

That is, the cutter housing 15 may selectively engage the engagement member 12*b* of the carriage device 12*a* of the image forming apparatus 100 to move across the media transport path 11 thereof. The pair of rotary cutting wheels 16 may be rotatably coupled to the cutter housing 15 and form an overlap region therebetween. The rotary cutting wheels 16 may pass through a cutting region 25 to cut media transported along the media transport path 11. The cutter guide 17 may be disposed lower than the pair of rotary cutting wheels 16. For example, the cutting guide 17 may be below the rotary cutting wheels 16 with respect to a gravitational direction $d_g$. The gear assembly 18 may engage the cutter guide 17 and one of the rotary cutting wheels 16*b* to rotate the one rotary cutting wheel 16*b* in response to a movement of the cutter housing 15 across the media transport path 11. The one rotating rotary cutting wheel 16*b* may rotate the other rotating rotary cutting wheel 16*a* through contact therewith. In examples, the rotary cutting wheels 16 may cut the respective media without media control members to provide tension at the cutting region 25 disposed downstream, for example, from an output shaft 29 and the rotary cutting wheels 16 as illustrated in FIG. 3.

Figure 7:
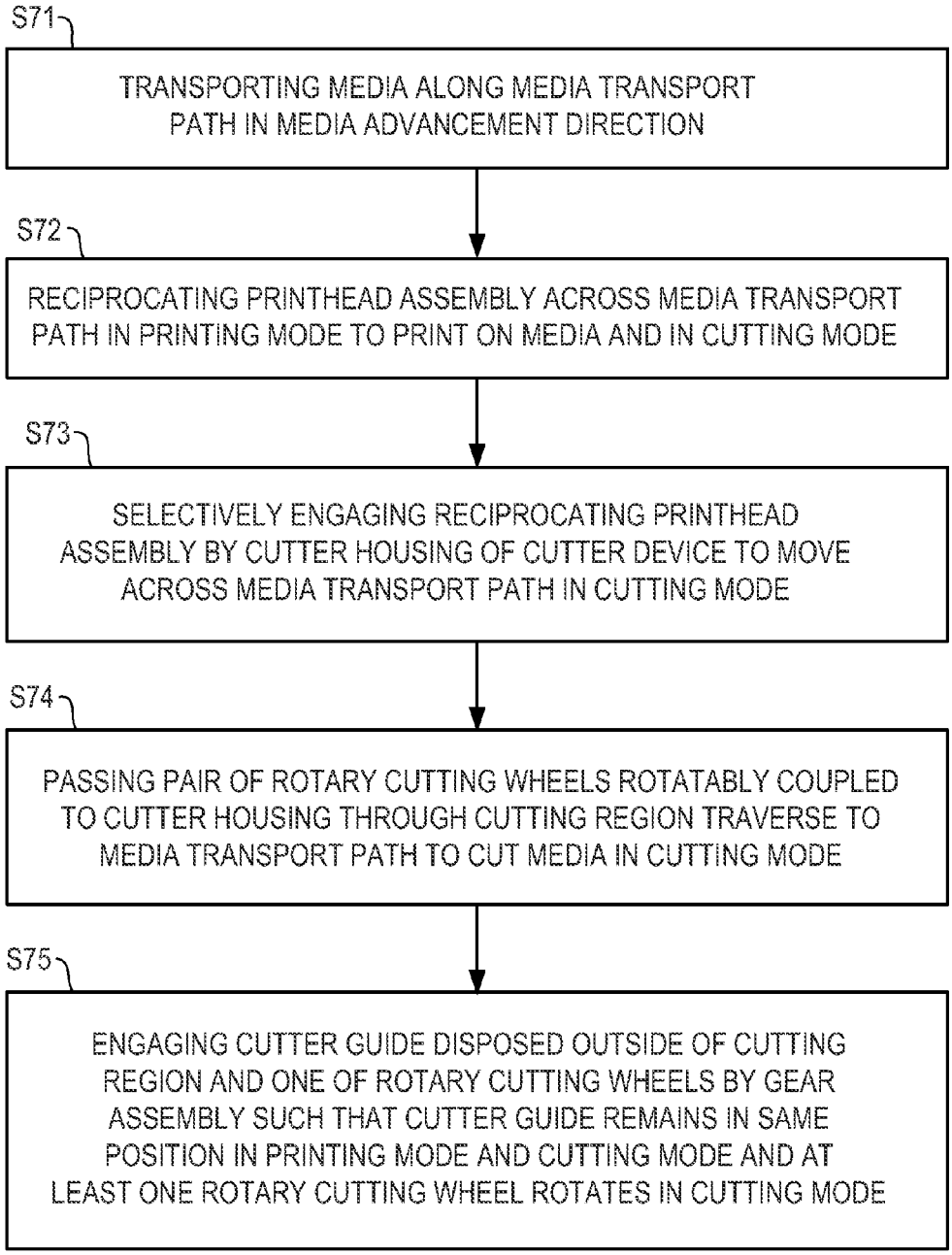
FIG. 7 is a flowchart illustrating a method of cutting media in an image forming apparatus according to an example.

FIG. 7 is a flowchart illustrating a method of cutting media in an image forming apparatus according to an example. Referring to FIG. 7, in block S71, media is transported along a media transport path in a media advancement direction. For example, the media is transported along the media transport path to a cutting region by an output shaft disposed upstream from the pair of rotary cutting wheels of the cutting device in the media advancement direction. In block S72, a reciprocating printhead assembly is reciprocated across the media transport path in a printing mode to print on the media and in a cutting mode. For example, in the cutting mode, the reciprocating printhead assembly engages a cutter housing including the pair of rotary cutting wheels and transports the cutter housing across the media transport path to cut the media. In block S73, the reciprocating printhead assembly is selectively engaged by a cutter housing of a cutter device to move across the media transport path in the cutting mode. For example, in the cutting mode, the reciprocating printhead assembly engages a cutter housing including the pair of rotary cutting wheels and transports the cutter housing across the media transport path to cut the media.

In block S74, a pair of rotary cutting wheels rotatably coupled to the cutter housing is passed through a cutting region traverse to the media transport path to cut media in the cutting mode. For examples, the pair of rotating rotary cutting wheels may pass through the cutting region to cut the media transported along the media transport path without a media control member disposed downstream from the rotary cutting wheels in the media advancement direction. That is, no media control member to provide tension to the media at the cutting region is disposed downstream from the rotary cutting wheels with respect to a media advancement direction. In block S75, a cutter guide disposed outside of the cutting region and one of the rotary cutting wheels is engaged by a gear assembly such that the cutter guide remains in a same position in the printing mode and the cutting mode and at least the one rotary cutting wheel rotates in the cutting mode. For example, the cutter guide may be out of the way of the media transport path and fixed in one position.

The method may also include the other rotary cutting wheel rotating through contact with the one rotary cutting wheel rotating in response to the gear assembly engaging and moving along the cutting guide. That is, as the reciprocating printhead assembly pulls or pushes the cutter housing including the pair of rotary cutting wheels and the gear assembly along the cutter guide, the gear assembly in contact therewith imparts rotation to one rotary cutting member. The one rotating rotary cutting member imparts rotation to the other rotary cutting wheel through its contact therewith. The method may also include the cutter housing being placed in a park position away from the media transport path during the print mode and the reciprocating printhead assembly being engaged by the cutter housing in the park position to move the cutter housing across the media transport path to cut the media during the cutting mode.

It is to be understood that the flowchart of FIG. 7 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 7 illustrates a specific order of execution, the order of execution may differ from that which is depicted. For example, the order of execution of two or more blocks may be scrambled relative to the order illustrated. Also, two or more blocks illustrated in succession in FIG. 7 may be executed concurrently or with partial concurrence. All such variations are within the scope of the present disclosure.

The present disclosure has been described using non-limiting detailed descriptions of examples thereof that are not intended to limit the scope of the present disclosure. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the present disclosure and which are described for illustrative purposes. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

a media transport path to transport media in a media advancement direction;

a reciprocating printhead assembly to reciprocate across the media transport path in a printing mode to print on the media and in a cutting mode; and a cutter device including a cutter housing, a pair of rotary cutting wheels, a cutter guide, and a gear assembly;

the cutter housing to selectively engage the reciprocating printhead assembly to move across the media transport path in the cutting mode;

the pair of rotary cutting wheels rotatably coupled to the cutter housing to pass through a cutting region traverse to the media transport path to cut the media in the cutting mode;

the cutter guide disposed outside of the cutting region to remain in a same position in the printing mode and the cutting mode; and the gear assembly to engage the cutter guide and one of the rotary cutting wheels to rotate at least one of the rotary cutting wheels in the cutting mode.

2. The image forming apparatus according to claim 1, wherein the media is in a form of a roll media.

3. The image forming apparatus according to claim 1, wherein the media is in a form of roll media and sheet media such that each of the roll media and the sheet media is sequentially transported along the media transport path.

4. The image forming apparatus according to claim 1, wherein the gear assembly engages the cutter guide and one of the rotary cutting wheels to rotate at least one of the rotary cutting wheels in the cutting mode in response to a movement of the cutter housing across the media transport path.

5. The image forming apparatus according to claim 1, wherein each one of the pair of rotary cutting wheels is in contact with each other to allow a rotation of one rotary cutting wheel to rotate the other rotary cutting wheel.

6. The image forming apparatus according to claim 5, wherein a peripheral speed of the rotating rotary cutting wheels is faster than a linear speed of the cutter housing moving along the cutter guide.

7. The image forming apparatus according to claim 1, wherein the gear assembly comprises:

a first circular gear member coupled to one of the rotary cutting wheels, the first circular gear member having a first radius thereof; and a pair of secondary circular gear members to engage the cutter guide each having a second radius; and a third circular gear member coupled to the pair of secondary circular gear members and the first circular gear member to rotate the one rotary cutting wheel, the third circular gear member having a third radius thereof greater than the first radius and the second radius.

8. The image forming apparatus according to claim 1, further comprising:

an output shaft to transport the media along the media transport path to the cutting region such that the output shaft is disposed upstream from the pair of rotary cutting wheels of the cutting device in the media advancement direction.

9. The image forming apparatus according to claim 8, wherein the pair of rotary cutting wheels passes through the cutting region to cut the media transported along the media transport path without a media control member to provide tension to the media at the cutting region disposed downstream from the rotary cutting wheels in the media advancement direction.

10. The image forming apparatus according to claim 8, wherein the cutter guide is disposed below the output shaft.

11. A cutter device usable with an image forming apparatus including a carriage device and a media transport path, the cutter device comprising:

a cutter housing to selectively engage the carriage device of the image forming apparatus to move across the media transport path thereof;

a pair of rotary cutting wheels rotatably coupled to the cutter housing and forming an overlap region therebetween, the rotary cutting wheels to pass through a cutting region to cut media transported along the media transport path;

a cutter guide disposed lower than the pair of rotary cutting wheels; and a gear assembly to engage the cutter guide and one of the rotary cutting wheels to rotate at least one of the rotary cutting wheels in response to a movement of the cutter housing across the media transport path.

12. The cutter device according to claim 11, wherein the media is in a form of the roll media and sheet media such that each one of the roll media and the sheet media is sequentially transported along the media transport path.

13. The cutter device according to claim 11, wherein each one of the pair of rotary cutting wheels is in contact with each other to allow rotation of one rotary cutting wheel to rotate the other rotary cutting wheel such that a peripheral speed of the rotating cutting wheels is faster than a linear speed of the cutter housing moving along the cutter guide.

14. The cutter device according to claim 11, wherein the gear assembly comprises:

a first circular gear member coupled to one of the rotary cutting wheels, the first circular gear member having a first radius thereof; and a pair of secondary circular gear members to engage the cutter guide each having a second radius; and a third circular gear member coupled to the pair of secondary circular gear members and the first circular gear member to rotate the one rotary cutting wheel, the third circular gear member having a third radius thereof greater than the first radius and the second radius.

15. A method of cutting media in an image forming apparatus, the method comprising:

transporting media along a media transport path in a media advancement direction;

reciprocating a printhead assembly across the media transport path in a printing mode to print on the media and in a cutting mode;

selectively engaging the reciprocating printhead assembly by a cutter housing of a cutter device to move across the media transport path in the cutting mode;

passing a pair of rotary cutting wheels rotatably coupled to the cutter housing through a cutting region traverse to the media transport path to cut media in the cutting mode; and engaging a cutter guide disposed outside of the cutting region and one of the rotary cutting wheels by a gear assembly such that the cutter guide remains in a same position in the printing mode and the cutting mode and at least the one rotary cutting wheel rotates in the cutting mode.

16. The method according to claim 15, further comprising:

rotating the other rotary cutting wheel through contact with the one rotary cutting wheel rotating in response to the gear assembly engaging and moving along the cutting guide.

17. The method according to claim 16, wherein a peripheral speed of the rotating rotary cutting wheels is faster than a linear speed of the cutter housing moving along the cutter guide.

18. The method according to claim 15, wherein the transporting media along a media transport path in a media advancement direction comprises:

transporting the media along the media transport path to the cutting region by an output shaft disposed upstream from the pair of rotary cutting wheels of the cutting device in the media advancement direction.

19. The method according to claim 18, wherein the passing a pair of rotary cutting wheels rotatably coupled to the cutter housing through a cutting region traverse to the media transport path to cut media in the cutting mode comprises:

passing the pair of rotary cutting wheels rotating through the cutting region to cut the media transported along the media transport path without a media control member to provide tension to the media at the cutting region disposed downstream from the rotary cutting wheels in the media advancement direction.

20. The method according to claim 15, further comprising:

placing the cutter housing in a park position away from the media transport path during the print mode; and engaging the reciprocating printhead assembly by the cutter housing in the park position to move the cutter housing across the media transport path during the cutting mode.

* * * * *

UNITED STATES PATENT AND TRADEMARK OFFICE

CERTIFICATE OF CORRECTION

PATENT NO. : 8,529,145 B2
APPLICATION NO. : 13/117810
DATED : September 10, 2013
INVENTOR(S) : Carton Cordero et al.

It is certified that error appears in the above-identified patent and that said Letters Patent is hereby corrected as shown below:

On the title page, in Item [73], delete "L. P.," and insert -- L.P., --, therefor.

Signed and Sealed this
Third Day of June, 2014

Michelle K. Lee

Michelle K. Lee
*Deputy Director of the United States Patent and Trademark Office*